United States Patent [19]

Ragen

[11] 4,444,371

[45] Apr. 24, 1984

[54] HANGER ASSEMBLY

[76] Inventor: Peter D. Ragen, 921 S. 102nd St., West Allis, Wis. 53214

[21] Appl. No.: 280,826

[22] Filed: Jul. 6, 1981

[51] Int. Cl.[3] ..... F16L 3/08

[52] U.S. Cl. ..... 248/225.31; 248/220.2

[58] Field of Search ..... 248/225.3 R, 220.2, 248/534, 538, 539, 205 R, 226.2, 227.1, 288.1, 295.1, 214, 544, 206 R, 262, 264

[56] References Cited

U.S. PATENT DOCUMENTS

| | | | |
|---|---|---|---|
| 2,506,119 | 5/1950 | Tregear | 248/205 R |
| 3,943,524 | 3/1976 | Sample | 248/539 |
| 3,978,612 | 9/1976 | Young | 248/206 R |
| 4,074,882 | 2/1978 | Anderson | 248/226.2 |
| 4,156,982 | 6/1979 | Phillips, Jr. | 248/538 |
| 4,340,199 | 7/1982 | Brock | 248/544 |

*Primary Examiner*—William H. Schultz
*Assistant Examiner*—Ramon O. Ramirez
*Attorney, Agent, or Firm*—Wheeler Law Firm

[57] ABSTRACT

A hanger assembly includes an L-shaped clip and a hanger member which slidably engages an elongate slot formed in one leg of the clip for support. The other leg of the clip is also apertured to permit attachment to support structure. A second L-shaped clip having a complementary slot in one leg may also be provided. The distance between the slot and the opposite leg in one clip is greater than the other so that the slots will be in alignment when the other legs are in an overlapping relation. The other leg of the second clip is also apertured so that when the other legs are in alignment a threaded fastener may pass through each for attachment to support structure.

5 Claims, 8 Drawing Figures

HANGER ASSEMBLY

BACKGROUND OF THE INVENTION

This invention relates to hangers and more particularly to hangers for suspending objects such as potted plants and clothing from railings, doors, window frames, and the like. Such hangers normally include a bracket which generally conforms in shape to the supporting structural member.

While these prior art hanger assemblies have provided satisfactory means for suspending small objects, it has been difficult to adapt such hangers to supporting structures having a variety of configurations.

SUMMARY OF THE INVENTION

In general terms the invention comprises hanger assembly including an elongate hanger member having a substantially straight lower leg and an upper arm terminating in an abbreviated spiral scroll for suspending an article therefrom. A detachable L-shaped clip and a threaded fastener are employed to secure the hanger to a supporting structure. The clip has an elongate slot for receiving the lower leg of the hanger and a plurality of clearance holes for receiving one or more threaded fasteners and a threaded hole which is employed when the rail clip is cooperatively used with an optional window clip to support the hanger. The rigid L-shaped detachable window clip may also be employed alone to support the hanger and has an elongate aperture and a pair of clearance holes to receive on or more threaded fasteners.

It is an object of the invention to provide a new and improved hanger for suspending small objects from a structural member.

Another object of the invention is to provide a hanger assembly which is adaptably mounted to a variously shaped support members.

Yet another object of the invention is to provide a hanger assembly which may be readily installed using only simple tools.

These and other objects of the present invention will become more apparent from the detailed description thereof taken with the accompanying drawings.

DETAILED DESCRIPTION OF THE PREFERRED EMBODIMENT

Figure 1:
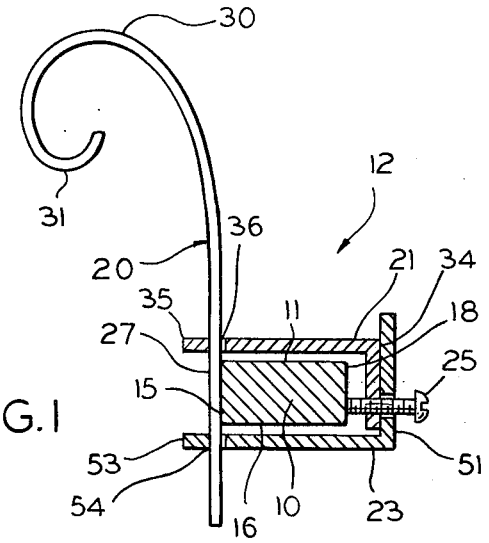
FIG. 1 is a side elevational view, partly in section, of the hanger according to the preferred embodiment of the invention.

In FIG. 1, the invention is illustrated in connection with a horizontally disposed elongate railing 10 to which the hanger assembly 12 of the present invention is releasably clamped. Railing 10 is shown to be generally rectangular in cross-section and having an upper surface 11, a front face 15, a lower surface 16 and a rear face 18. Railing 10 is intermittently supported in a well known manner on support posts (not shown).

The hanger assembly 12 includes a hanger member 20 and a pair of L-shaped clips 21 and 23 formed of a suitable metallic material and a threaded fastener 25. Hanger member 20 may comprise a strip of material having any convenient cross-sectional shape, such as rectangular and of sufficient thickness for necessary strength and rigidity. Hanger member 20 has a substantially straight lower leg 27 and an upwardly and outwardly curved upper portion 30 which terminates in a hook-like reversely curved end 31.

Figure 2:
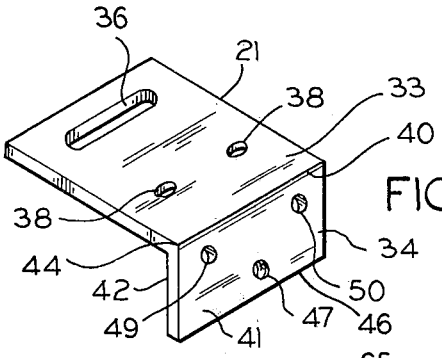
FIG. 2 is a perspective view of one portion of the hanger shown in FIG. 1.

As seen in FIG. 2, clip 21 includes planar flanges or legs 33 and 34. Flange 33 may be generally rectangular and has an elongate slot 36 formed transversely adjacent in free end 35. Flange 33 also has a pair of clearance holes 38 laterally spaced apart midway between its inner end 40 and slot 36. Flange 34 may also be generally rectangular and has outer and inner faces 41 and 42 and a threaded hole 47 adjacent its lower end edge 46. Threaded hole 47 is adapted to receive a bolt 25 as seen in FIG. 1. Flange 34 further includes a pair of clearance holes, 49 and 50, between flange 21 and threaded hole 47. The diameter of clearance holes 49 and 50 is slightly larger than the thread diameter of bolt 25.

Figure 3:
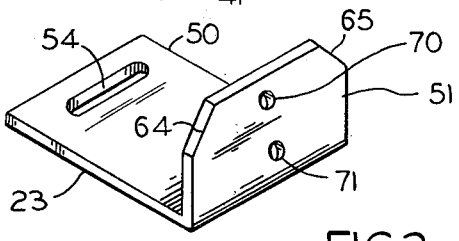
FIG. 3 is a perspective view of a second portion of the hanger shown in FIG. 1.

The second clip 23 is shown in FIG. 3 to include a pair of planar, flanges or legs 50 and 51. Flange 50 may be generally rectangular in shape and has an elongate, transversely extending slot 54 near its free end. The slots 36 and 54 of flanges 21 and 50 are similarly shaped to receive, with slight peripheral clearance, the lower leg 27 of hanger member 20. The sides of flange 51 may be tapered inwardly adjacent their upper ends at 64, 65 to facilitate insertion of the flange behind molding and the like. Flange 51 may have a pair of spaced clearance holes, 70 and 71 formed therein. The diameter of clearance holes 70, 71 is selected to slightly exceed the thread diameter of bolt 25.

As shown in FIG. 1, when the hanger 12 is to be mounted upon a railing 10, clip 21 is placed over the railing's upper surface 11 with the free end 35 of flange 21 projecting beyond the front face 15 and the flange 34 projecting downwardly and generally parallel to the rear face 18. Clip 23 is placed adjacent the underside 16 of railing 10 with the free end 53 of flange 50 projecting beyond the front face 15. The length of flange 50 from its free end 53 to flange 51 is selected to slightly exceed the combined length of flange 33 and thickness of flange 34. The flange 51 is thus disposed outwardly of flange 34 and in an upwardly projecting attitude. With the apertures 36 and 54 in general vertical registry, the lower leg 28 of hanger member 20 is inserted downwardly to extend through the apertures 36 and 54 of flanges 33 and 50, respectively. The second clearance hole 71 of flange 51 and the threaded hole 47 of flange 34 are aligned in general registry and bolt 25 extends through second clearance hole and is in threaded engagement with hole 47. In assembly, bolt 25 is advanced until its inner end abuts the rear railing face 18 so that upon further tightening the flange 34 is moved into engagement with flange 51 and both are moved away from face 18 whereby the lower leg 27 of member 20 is clamped between apertures 36 and 54 and railing 10.

Figure 4:
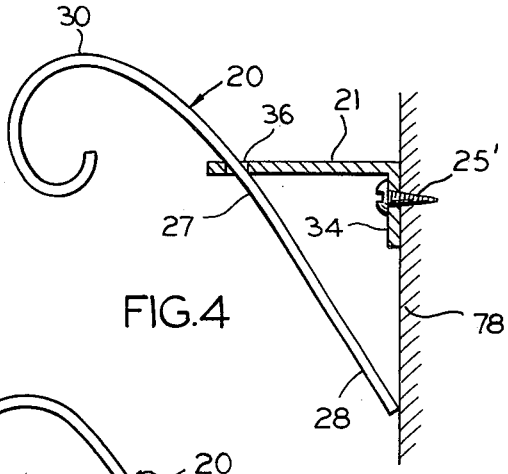
FIG. 4 is a side elevational view of another embodiment of the invention.

FIG. 4 illustrates an alternate method of mounting member 20. Specifically, clip 21 may be used alone to mount hanger member 20 upon a vertical plane surface such as a wall 78. Here, flange 34 is oriented downwardly with its outer face abutting wall 78 and is affixed thereto by screws 25' which extend through clearance holes 49 and 50. The hanger end 28 may then be inserted downwardly through aperture 36 and hanger arm 30 is tilted outwardly to abut the leg end 28 against wall 78. Frictional forces between lower leg 27 and aperture 36 and between leg end 28 and wall 78 cooperate to support the suspended load.

Figure 5:
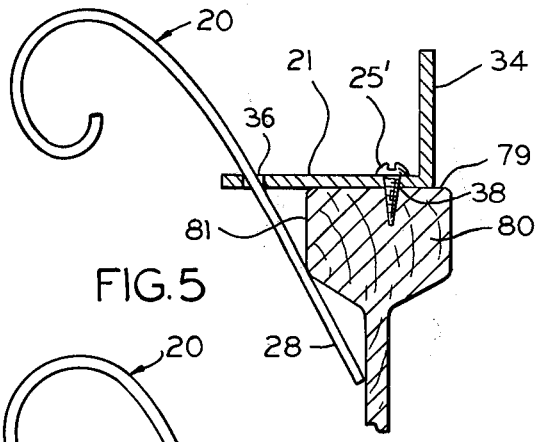
FIG. 5 is a side elevational view of yet another embodiment of the invention.

A further method of hanging member 20 by means of clip 21 is shown in FIG. 5. Here clip 21 is disposed atop the horizontal surface 79 of a wooden rail 80 with aperture 36 positioned outward of the vertical surface 81. The flange 34 is oriented upwardly and clearance holes 38 are centered laterally on the horizontal surface 80. A pair of screws 25' are inserted through clearance holes 38 and tightened. Hanger member 20 is supported as in FIG. 4.

Figure 6:
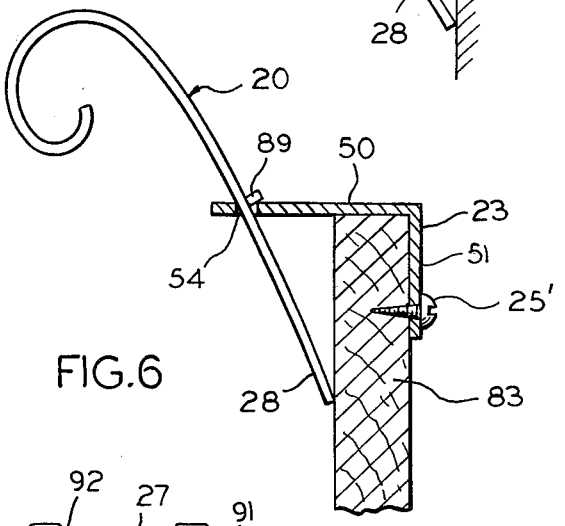
FIG. 6 is a side elevational view of still another embodiment of the invention.

In FIG. 6 clip 23 is used alone to mount hanger member 20 upon a door 83 or similar structure. Flange 50 is disposed atop the horizontal surface with flange affixed the rear vertical surface by screws 25'.

Figure 7:
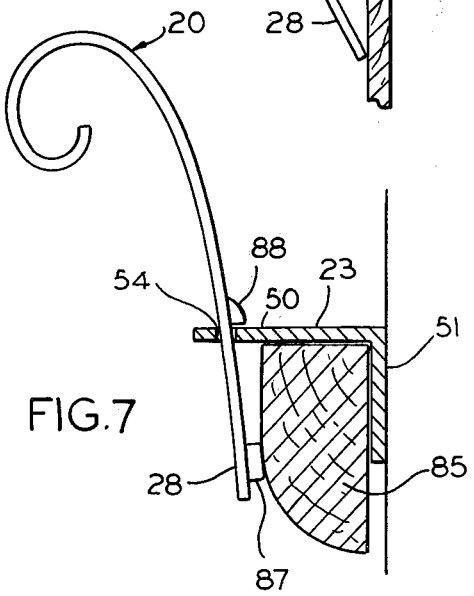
FIG. 7 is a side elevational view of another embodiment of the invention.

FIG. 7 shows how clip 23 may be used to mount hanger member 20 upon a support structure such as a molding 85. In particular flange 51 is inserted between molding 85 and the adjacent vertical. To avoid damage to the supporting structure and to increase the frictional forces aiding hanger retention, a rubber bumper 87 may be deployed between the end 28 of member 20 and the molding 85.

A projecting rib 88 or lug 89 (FIGS. 6 and 7) may optionally be employed and disposed along the surface of hanger member 20 adjacent the inner edge of aperture 54. Rib 88 or lug 89 have a projecting dimension to overlap inner edge of aperture 54, thereby preventing hanger member 20 from sliding downward when a load is suspended therefrom.

Figure 8:
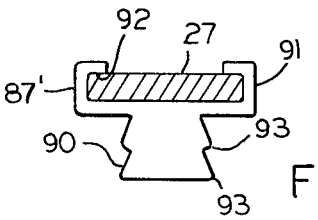
FIG. 8 is a cross-sectional view of an alternate embodiment of the invention.

FIG. 8 shows an alternate form of the bumper 87' to include a body portion 90 and a head portion 91 provided with a slot 92. The head portion 91 is slid over the lower leg 27 so that the slot embraces the member for mounting and support. The body portion 90 is provided with indexing ridges 93 to facilitate the removal, by sawing for example, of a part of body portion 90. In this manner the bumper can be more accurately sized.

While only a few embodiments of the invention have been illustrated and described, it is not intended to be limited thereby but only by the scope of the appended claims.

I claim:

1. A hanger assembly including:

an elongate hanger member having hanger means formed at one end and a relatively linear portion at its opposite end, first clip means including first and second legs oriented generally normally one to the other, said first leg having an elongate slot formed therein for receiving the opposite end of said hanger member, an aperture formed in one of said legs and adapted to receive a fastener for mounting said first clip to support structure with said first leg extending generally horizontally and said slot oriented vertically, second clip means having first and second legs oriented generally normally, an elongate slot formed in the first leg of said second clip means and complementary to the slot in the first clip means, and an aperture formed in the second legs of each said clip means and adapted to be in alignment when said second legs are disposed in a side-by-side relation and said slots are in alignment, one of said apertures being threaded for receiving a threaded fastener, whereby when the opposite end of said hanger member extends through said slot it will engage and be supported by the edges of said slot and said support structure to permit an object to be hung from said hanger means.

2. The assembly set forth in claim 1 wherein said hanger member is formed of a strip of material which is substantially wider than its thickness, said slots being formed adjacent the ends of said first legs and extending generally transversely thereto, said slots being complementary to the cross-sectional shape of said member and sized to loosely receive the same.

3. The assembly set forth in claim 2 wherein the distance between the slot and the second leg of one clip means is greater than that of the other so that the slots will be in alignment when said second legs are in a proximate, generally parallel relation and said first legs are spaced apart.

4. A hanger assembly including:

an elongate hanger member having hanger means formed at one end and a relatively linear portion at its opposite end, clip means including first and second legs oriented generally normally one to the other, said first leg having an elongate slot formed therein for receiving the opposite end of said hanger member, at least one of said legs being adapted to engage a support structure, said hanger member being formed of a strip of material which is substantially wider than its thickness, said slot being formed adjacent the end of said one leg and extending generally transversely and being complementary to the cross-sectional shape of said member and sized to loosely receive the same, whereby when the opposite end of said hanger member extends through said slot it will engage and be supported by the edges of said slot and said support structure to permit an object to be hung from said hanger means, a bumper having a slot formed therein for being received on said opposite end of said hanger member, said bumper having a body portion projecting away from said slot for engaging a surface adjacent to said support structure, said body portion having indexing marks therein to facilitate the removal of a part of said body portion.

5. The assembly set forth in claim 4 and including projecting means extending from the surface of said hanger member for engaging the margin of said slot to support said hanger member therein.

* * * * *